US006771225B2

(12) United States Patent
Tits

(10) Patent No.: US 6,771,225 B2
(45) Date of Patent: Aug. 3, 2004

(54) LOW COST HIGH PERFORMANCE ANTENNA FOR USE IN INTERACTIVE SATELLITE TERMINALS

(75) Inventor: Daniel Tits, Droue sur Drouette (FR)

(73) Assignee: Eutelsat SA, Paris (FR)

( * ) Notice: Subject to any disclaimer, the term of this patent is extended or adjusted under 35 U.S.C. 154(b) by 0 days.

(21) Appl. No.: 10/197,222

(22) Filed: Jul. 17, 2002

(65) Prior Publication Data

US 2003/0025641 A1 Feb. 6, 2003

(30) Foreign Application Priority Data

Jul. 20, 2001 (EP) ..... 01401959

(51) Int. Cl.[7] ..... H01Q 13/00
(52) U.S. Cl. ..... 343/786; 343/781 R
(58) Field of Search ..... 343/786, 781 R, 343/840, 776, 761, 839, 756, 909, 910; 333/21 A, 239

(56) References Cited

U.S. PATENT DOCUMENTS 5,614,916 A * 3/1997 Mizuguchi ..... 343/786
5,724,050 A 3/1998 Tokuda et al. ..... 343/756
5,796,370 A * 8/1998 Courtonne et al. ..... 343/781
5,812,096 A * 9/1998 Tilford ..... 343/781 R

FOREIGN PATENT DOCUMENTS

| | | |
|---|---|---|
| EP | 1018781 | 7/2000 |
| EP | 1 018 781 A2 | 7/2000 |
| GB | 1525514 | 9/1978 |

* cited by examiner

*Primary Examiner*—James Clinger
(74) *Attorney, Agent, or Firm*—Ladas & Parry

(57) ABSTRACT

The invention relates to a Interactive Satellite Terminal antenna system comprising an antenna to which is associated a feed horn. This antenna systems characterized in that it comprises an elliptical parabolic main reflector and a corrugated feed horn (2) having an outer elliptical aperture and an inner cylindrical waveguide with an inner portion (7) and a step section (8) and in that cavity elements (10) are added to the step section (8) for compensating cross-polar components. The invention can be used in antenna systems.

18 Claims, 4 Drawing Sheets

IV E
IV B
7
8
10
11
Dg
Ds
Ap
Dw
Dn

LOW COST HIGH PERFORMANCE ANTENNA FOR USE IN INTERACTIVE SATELLITE TERMINALS

The invention relates to an antenna to which is associated a feed horn, optimised for use in Interactive Satellite Terminals.

For the successful introduction of large interactive networks accessed by several tens of thousands of individual interactive user terminals each constituting of an indoor equipment and associated outdoor equipment (i.e. antenna and transmit/receive electronics), it is essential to have available on the market cost effective, high performance, transmit/receive satellite antennae. It is known that the antenna forms one of the crucial components of these terminals. At present it is always been taken for granted that high performance transmit antennae cannot be created at reasonable pricing.

The object of the present invention is to propose a high performance antenna system to meet existing regulatory and operational specifications but which can be produced at a reasonable price.

For realizing this objective, a satellite interactive terminal antenna according to the invention is characterised in that it comprises an elliptical antenna and a corrugated feed horn having an outer elliptical aperture and an inner cylindrical guide portion with a step therein, and in that cavity elements are added to the step portion for cross-polar component compensation. In addition, some essential mechanical features need to be implemented in order for the optimisation to be effective.

The invention will be better understood and its objects, features, details and advantages will appear more clearly in the following explanatory description referring to the annexed schematic diagrams cited as mere examples illustrating an embodiment of the invention and in which.

Figure 3:
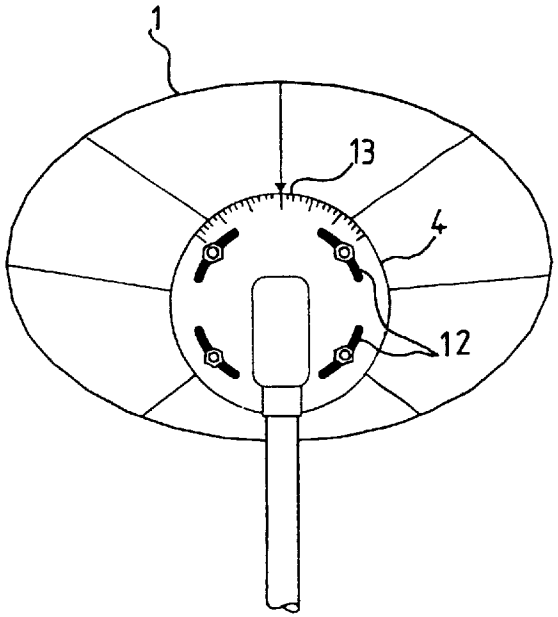
FIGS. 1 to 3 illustrate respectively a side view a front view and a back view of an elliptical compensated feed antenna arrangement according to the invention.
Figure 1:
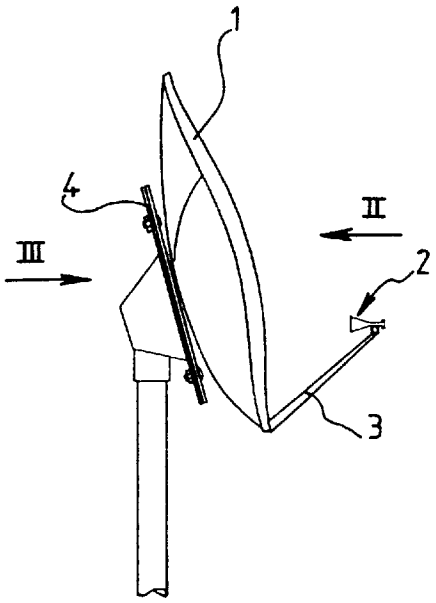
Figure 2:
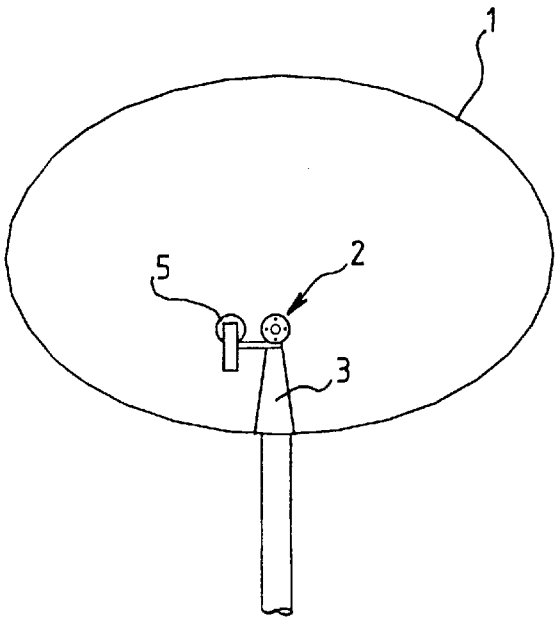

A schematic drawing of an interactive multi-satellite terminal antenna proposed by the invention is given in FIGS. 1, 2 and 3. The terminal comprises essentially an elliptical front-fed main reflector 1, a compensated feed horn 2 carried by a feed arm 3 secured to the lower peripheral portion of the reflector 1, a swivel plate 4 on which the main reflector 1 is mounted and as optional possibility a second feed 5 mounted on feed arm 3 adjacent to the compensated feed 2, for the reception of another neighbouring satellite. The elliptical reflector 1 can be a commercially available reflector.

In choosing an elliptical configuration, high inter-satellite isolation will be obtained and multi-satellite operation will be facilitated. However the front-fed reflector geometry due to its short focal length has the drawback that the cross-polar diagram shows rather high lobes which can be well above 20 dB and are close to the antenna main direction of pointing and this means that even with fairly highly accurate pointing good cross-polar discrimination performance cannot be obtained.

This problem is overcome by the compensated feed system 2 that electrically counter-acts the depolarization caused by the main reflector, i.e. by creating a specific microwave mode that has the same amplitude but opposite phase as the depolarization component induced by the main reflector.

Figures 4A, 4B, 4C:
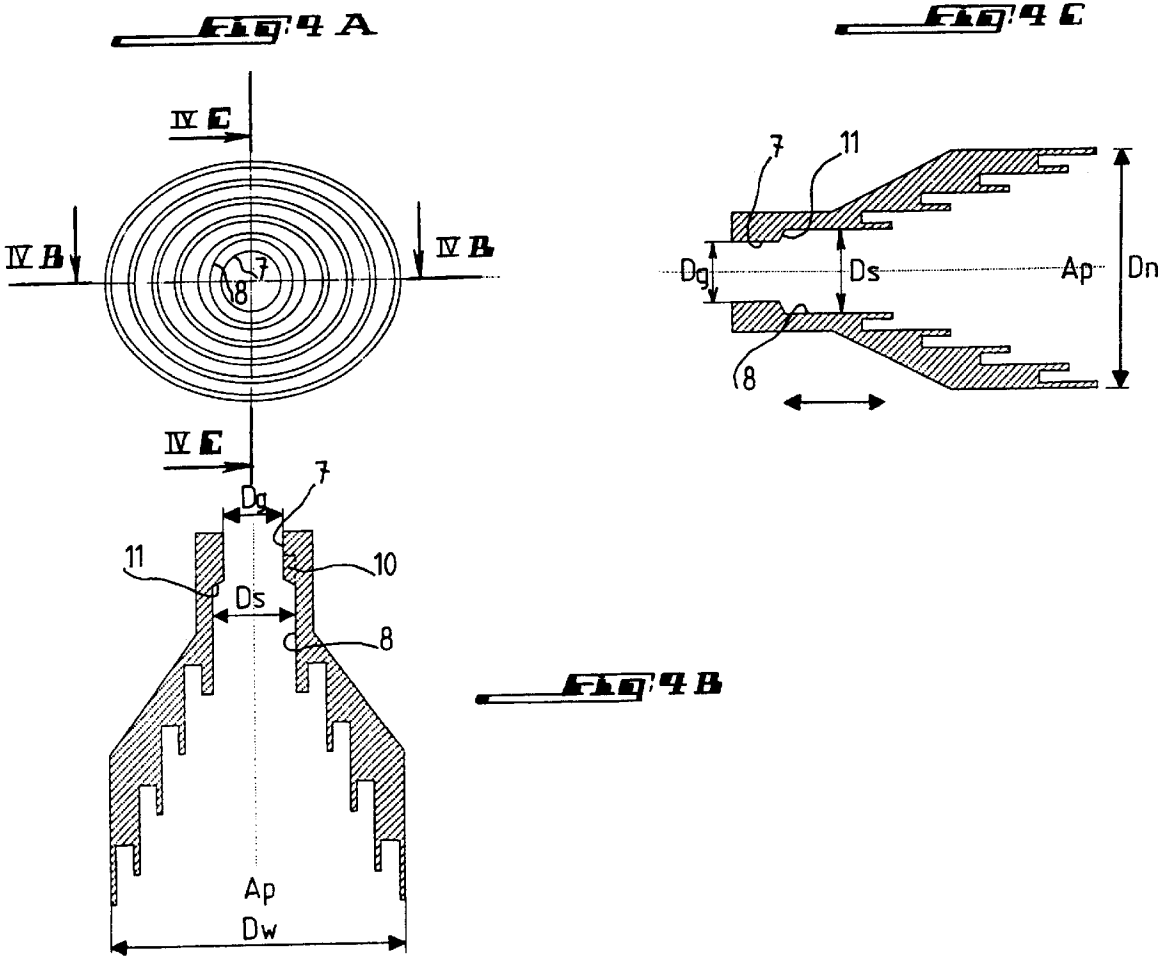
FIG. 4 illustrates in a schematic manner an elliptical feed horn device in accordance to the invention, by three different views indicated by a, b and c.
Figure 6:
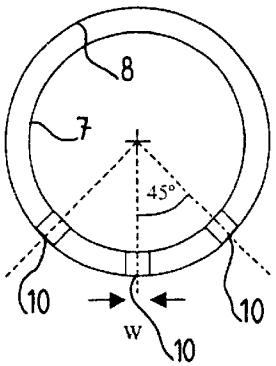
FIGS. 5 and 6 is a schematic view of a preferred embodiment of a feed horn proposed by the invention, including the cavity elements proposed by the invention.
Figure 5:
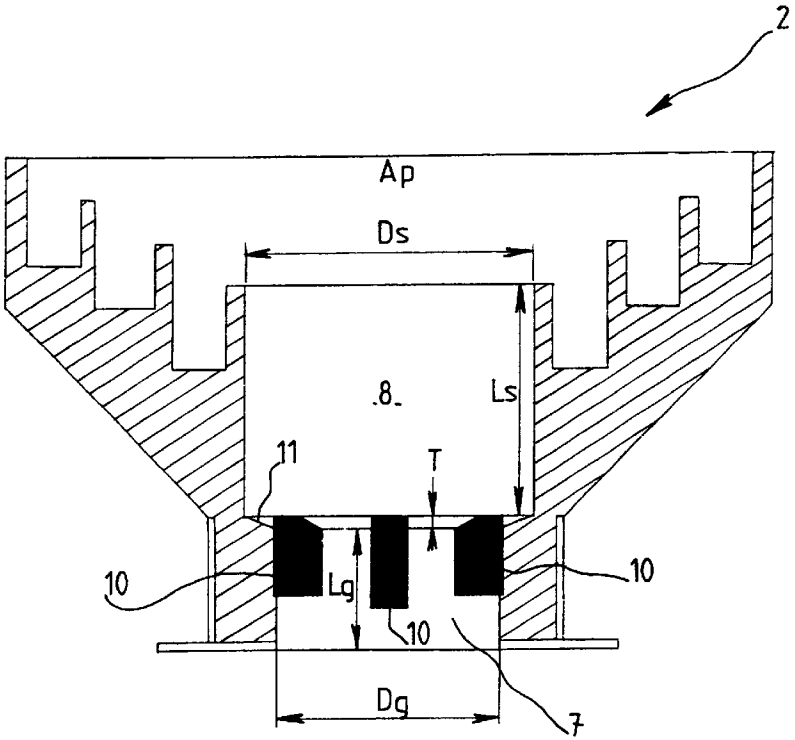

The FIGS. 4 to 6 illustrate the embodiment of a feed horn configuration that is conceived to compensate the above set forth depolarisation component. This compensated feed configuration has been developed in order to be applicable on elliptical antennae, to enhance transmission cross-polar discrimination, to be mass-producible and to not need any tuning. As shown in FIG. 4, the used feed horn has the general design of a corrugated feed horn having an elliptical aperture Ap with a wide diameter Dw and a narrow aperture diameter Dn, shown respectively in FIGS. 4*b*, 4*c* and an inner cylindrical waveguide portion 7 with a guide diameter Dg followed by a step section 8 having a diameter Ds.

It is in this throat section of the feed horn that the used feed design differs particularly from a conventional corrugated feed.

It has been found that the aforesaid compensation can be obtained by exciting a $TE_{21}$ mode in the cylindrical waveguide portion by creating an asymmetry therein. Indeed, the $TE_{21}$ mode is an asymmetric mode and therefore requires an asymmetry in the feed structure. The best method found for introducing the required asymmetry is to use longitudinal slots 10 in the guide, as shown in FIGS. 5 and 6. These slots are formed at the discontinuity of the waveguide as the diameter increases from the inner portion 7 to the step region 8. Such slots are formed parallel to the waveguide axis in the inner portion 7 and extending from the step 11 that is somewhat tapered. By altering the dimensions of the slots, the amplitude of the mode can be controlled.

The FIGS. 5 and 6 show a corrugated feed horn configuration with three slots 10. One slot is located in the y-axis so that it generates the required cross-polar field for the horizontal polarization. The other two slots are mounted at angles of +/−45° to this slot.

The slot dimensions are critical in determining the level of the mode generated. The length S of the slot and the width W of the slot play an important part in the level of mode generated along with the step in waveguide size. The longer the slot length S the greater the level of $TE_{21}$ mode generated. The depth D of the slot is basically half the difference between the guide diameter Dg and the step diameter Ds. The depth needs to be slightly smaller than this to ensure that the outer edge of the slot always lies within the step diameter. This is to ensure that the step can be die-cast. The taper T on the step section is not required for the horn to operate, but is included to ensure that the horn is easier to die-cast. If a perpendicular section is used at this point the tool can stick and be difficult to remove.

It was found that the two slots at 45° generated significant levels of higher order $TE_{21}$ mode. The level of the mode generated by the two slots for vertical polarization was very similar to that generated by the single slot for the horizontal polarization. It was found that the cross-polar cancellation has been achieved in both polarizations with the same feed set-up. As example the length of the centre slot was 7, 5 mm with the outer slots being 6, 5 mm in length. The centre slot was 3 mm and the outer slots were 2 mm wide. The step length Ls was 19 mm. The length of the input guide Lg was 10 mm and the diameters Ds and Dg were respectively 24 mm and 18 mm. The major axis of the aperture ellipse. The slots were oriented on the minor axis of the horn.

It is to be noted that the centre slot of the three slots 10 is the slot that controls the mode generation of the horizontal polarization along the major axis of the horn. The two slots of an angle of +/−45° to the minor axis of the horn generate the higher mode for the vertical polarisation. The step length is adjusted to get the phase of the cross-polar lobes to be in phase or anti-phase to the cross-polar pattern.

It is to be noted that since the compensation has no lossy elements, the absolute transmit and receive gain are not affected. Further, it should be mentioned that the compensation effect is frequency dependent, but has been proven to work over at least 5% frequency band. Thus at 14 GHz, some 500 MHz can be covered, at 30 GHz some 1000 MHz. With this, the transmit cross-polar isolation of the antenna is substantially improved and cross-polar lobes are largely reduced as low as 30 dB or even better.

In the following some further features and advantages of the invention will be described with referring to FIGS. 1 to 3.

Figure 7:
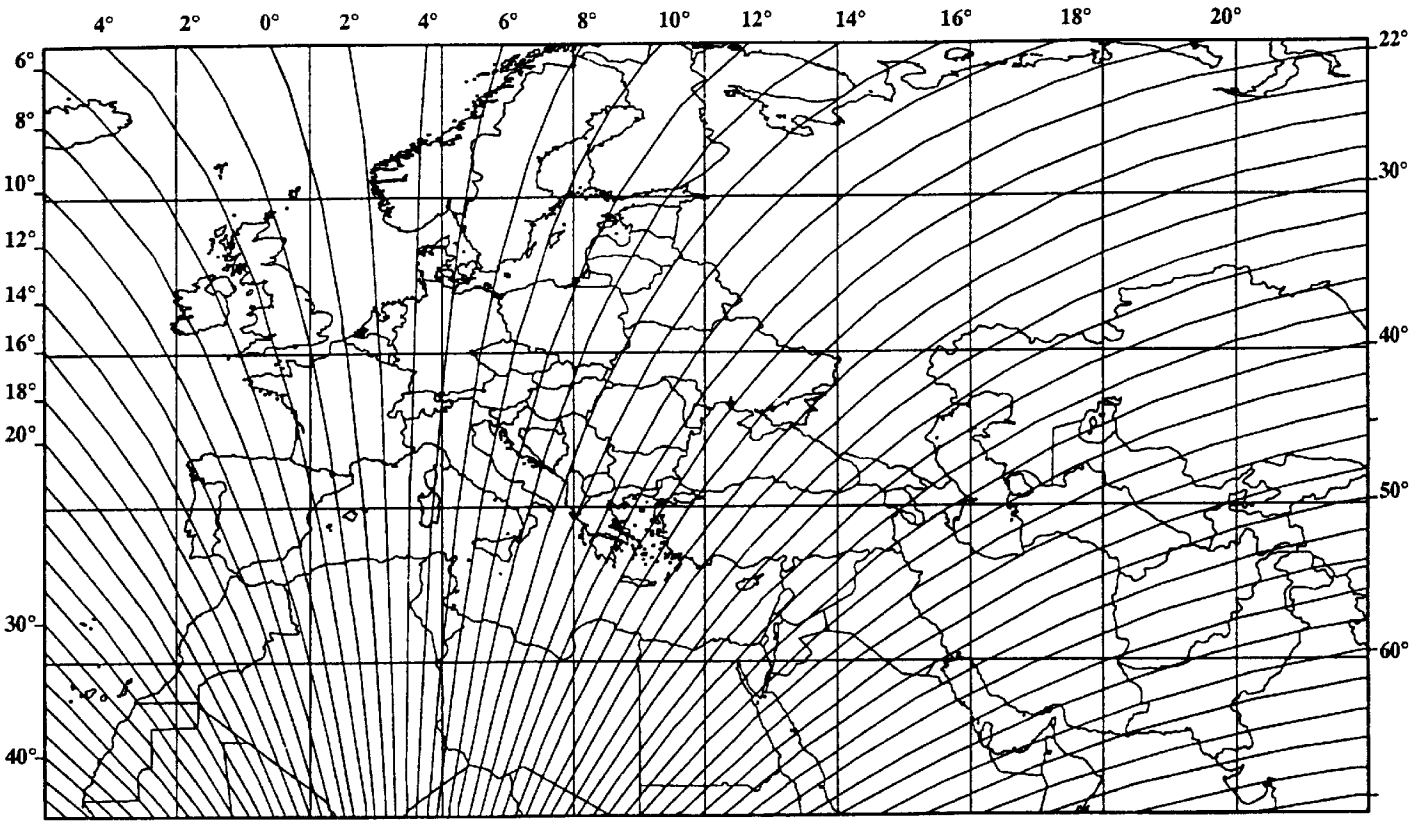
FIG. 7 shows a map with swivel-angle contours used for adjusting antenna polarisation plane.

Since the compensated feed is matched to counteract the depolarization caused by the main reflector 1, it is prohibited to apply feed rotation for adjusting the antennas polarization plane. The invention proposes for this purpose to rotate the entire antenna system. This rotation can be achieved in a cost effective way by means of the swivel plate 4 which is provided with slotted holes 12 extending in the peripheral direction and a degree scale shown at 13. The setting of the swivel angle is dependent on the location of the terminal and could be provided to the installer for instance with a simple map, showing swivel angle contours. FIG. 7 shows an example.

It is to be noted that, in principal, it is possible to carry out this swivel offset either around the electrical or mechanical axis of the antenna. Difference in required swivel angle can be taken into account in generating different swivel contours plots. In both cases correct alignment can be achieved.

Aligning in the manner described above effectively means that the major axis of the elliptical reflector 1 is aligned parallel to the geo-stationary orbit, as seen from the earth station, which has two major additional advantages.

First, it enables the reception of another neighbouring satellite simply by mounting a second feed, such as the feed 5 lateral to the main compensated feed 2, without an additional vertical displacement, thanks to the fact that the antenna is aligned with the orbit. This facilitates multi-satellite operation.

Secondly, it should be noted that according to industry regulations, relaxation of the maximum authorized equivalent isotropic radiated power (EIRP) can be obtained for elliptical antennae, on the condition that the major antenna axis is aligned with the geo-stationary orbit. In this case, only the more advantageous azimuth radiation pattern will be considered for determining this EIRP, which leads to higher authorized power levels. Obviously the proposed configuration meets this requirement thus achieving objective high maximum allowed EIRP allocation.

In summing up, the invention allows to use commercially available antennae with elliptical reference reflectors thanks to compensated feed horns which can be produced by using standard and mass production techniques without any need for tuning.

What is claimed is:

1. Interactive Satellite Terminal antenna system comprising:

an elliptical parabolic main reflector for reflecting an electromagnetic field having a fundamental mode and a cross polar component; and a compensated feed horn for feeding said electromagnetic field to said elliptical parabolic main reflector, said compensated feed horn having along a longitudinal axis from said elliptical parabolic main reflector an outer elliptical aperture, a step section with at least one slot to excite a higher order mode of reflected electromagnetic field and counteract said cross polar component, and an inner cylindrical waveguide.

2. Interactive Satellite Terminal antenna system according to claim 1, wherein said at least one slot extends parallel to said longitudinal axis and has a length establishing a predetermined level of said higher order mode for compensating said cross polar component.

3. Interactive Satellite Terminal antenna system, according to claim 2, wherein said at least one slot extends along a minor or major axis of said elliptical aperture.

4. Interactive Satellite Terminal antenna system according to claim 3, characterized in that, for adjusting the antenna polarization plane, the entire antenna system is rotatable as whole around an electrical axis which corresponds to an orientation in which the antenna provides a maximum gain.

5. Interactive Satellite Terminal antenna system according to claim 2, characterized in that, for adjusting the antenna polarization plane, the entire antenna system is rotatable as whole around an electrical axis which corresponds to an orientation in which the antenna provides a maximum gain.

6. Interactive Satellite Terminal antenna system according to claim 2, and further comprising a second feed mounted laterally to the longitudinal axis of the compensated feed horn for reception of a respective satellite.

7. Interactive Satellite Terminal antenna system according to claim 1, and further comprising a second feed (5) mounted laterally to said longitudinal axis of said compensated feed horn (2) for the reception of a respective satellite.

8. Interactive Satellite Terminal antenna system according to claim 1, characterized in that for adjusting the antenna polarization plane, the entire antenna system is rotatable as a whole around an electrical axis which corresponds to an orientation in which the antenna provides a maximum gain.

9. Interactive Satellite Terminal antenna system according to claim 8, characterized in that said entire antenna system is rotatable by means of a swivel plate (4) on which the antenna system is angularly adjustable thus resulting in the close alignment of the azimuth plane with orbital arc.

10. Interactive Satellite Terminal antenna system according to claim 9, and further comprising a second feed (5) mounted laterally to said longitudinal axis of said compensated feed horn (2) for the reception of a respective satellite.

11. Interactive Satellite Terminal antenna system according to claim 8, and further comprising a second feed (5) mounted laterally to said longitudinal axis of said compensated feed horn (2) for the reception of a respective satellite.

12. Interactive Satellite Terminal antenna system according to claim 1, wherein said at least one slot extends along a minor or major axis of said outer elliptical aperture.

13. Interactive Satellite Terminal antenna system according to claim 12, and further comprising a second feed mounted laterally to said longitudinal axis of said compensated feed horn for reception of a respective satellite.

14. Interactive Satellite Terminal antenna system according to claim 12, characterized in that for adjusting the antenna polarization plane, the entire antenna system is rotatable as a whole around an electrical axis which corresponds to an orientation in which the antenna provides a maximum gain.

15. Interactive Satellite Terminal antenna system according to claim 12, characterized in that said inner cylindrical waveguide portion (7) has a center and opposite side slots (10), said center slot being located in a major or minor axis of said outer elliptical aperture, and said opposite side slots being at angles of +/−45° to said center slot.

16. Interactive Satellite Terminal antenna system according to claim 15, characterized in that for adjusting the antenna polarization plane, the entire antenna system is rotatable as a whole around an electrical axis which corresponds to an orientation in which the antenna provides a maximum gain.

17. Interactive Satellite Terminal antenna system according to claim 15, and further comprising a second feed (5) mounted laterally to said longitudinal axis of said compensated feed horn (2) for the reception of a respective satellite.

18. Interactive Satellite Terminal antenna system according to claim 15, and further comprising a second feed (5) mounted laterally to said longitudinal axis of said compensated feed horn (2) for the reception of a respective satellite.

* * * * *